US010668508B2

(12) United States Patent
Nijland

(10) Patent No.: US 10,668,508 B2
(45) Date of Patent: Jun. 2, 2020

(54) METHOD FOR SWITCHING BETWEEN PRODUCT TYPES ON A SORTING SYSTEM FOR SORTING PRODUCTS SUCH AS VEGETABLES AND FRUIT AND SORTING SYSTEM THEREFOR

(71) Applicant: DE GREEF'S WAGEN-, CARROSSERIE-EN MACHINEBOUW B.V, Tricht (NL)

(72) Inventor: Wilhelm Jan Nijland, Veenendaal (NL)

(73) Assignee: DE GREEF'S WAGEN-, CARROSSERIEEN MACHINEBOUW B.V., Tricht (NL)

( * ) Notice: Subject to any disclaimer, the term of this patent is extended or adjusted under 35 U.S.C. 154(b) by 34 days.

(21) Appl. No.: 16/072,473

(22) PCT Filed: Jan. 24, 2017

(86) PCT No.: PCT/NL2017/050046
§ 371 (c)(1),
(2) Date: Jul. 24, 2018

(87) PCT Pub. No.: WO2017/131514
PCT Pub. Date: Aug. 3, 2017

(65) Prior Publication Data

US 2019/0076884 A1 Mar. 14, 2019

(30) Foreign Application Priority Data

Jan. 25, 2016 (NL) ..... 2016149

(51) Int. Cl.
*B07C 5/36* (2006.01)
*B07C 3/08* (2006.01)
*B07C 5/34* (2006.01)

(52) U.S. Cl.
CPC ..... *B07C 5/361* (2013.01); *B07C 3/08* (2013.01); *B07C 5/34* (2013.01); *B07C 5/36* (2013.01)

(58) Field of Classification Search
CPC .. B07C 5/34; B07C 5/36; B07C 5/361; B07C 3/08
(Continued)

(56) References Cited

U.S. PATENT DOCUMENTS 4,254,877 A * 3/1981 Rose ..... B07C 5/18 209/594
8,916,049 B2 * 12/2014 Nishijima ..... B03C 1/286 209/214
2014/0291217 A1 * 10/2014 Berdelle-Hilge ..... B07C 3/00 209/552

FOREIGN PATENT DOCUMENTS

DE 102011085458 A1 5/2013
EP 0729908 A1 9/1996
EP 0729908 A1 * 9/1996 ..... B65B 25/045

OTHER PUBLICATIONS

International Search Report and Written Opinion dated Apr. 24, 2017 in International Patent Application No. PCT/NL2017/050046, 11 pages.

* cited by examiner

*Primary Examiner* — Terrell H Matthews
(74) *Attorney, Agent, or Firm* — Shook, Hardy & Bacon L.L.P.

(57) ABSTRACT

The invention relates to a method for switching between different products such as vegetables and fruit on a sorting system, a computer-readable medium and sorting system suitable therefor, the method comprising of:—receiving a switching signal during sorting of products of the first product type that products of the second product type have
(Continued)

to be sorted;—the controller selecting sorting channels which are free of products of the first product type;—assigning at least some selected sorting channels to the second product type;—assigning sorting classes of the second product type to one or more of the assigned sorting channels; and—sorting products of the second product type in sorting channels assigned thereto during the emptying of sorting channels of the first product type. Preparatory emptying of some of the sorting channels optionally takes place prior to the switch-over.

20 Claims, 11 Drawing Sheets

(58) Field of Classification Search
USPC ..... 209/552, 651, 684, 192, 202
See application file for complete search history.

METHOD FOR SWITCHING BETWEEN PRODUCT TYPES ON A SORTING SYSTEM FOR SORTING PRODUCTS SUCH AS VEGETABLES AND FRUIT AND SORTING SYSTEM THEREFOR

CROSS-REFERENCE TO RELATED APPLICATIONS

This application claims priority under 35 U.S.C. § 365 to PCT/NL2017/050046, filed on Jan. 24, 2017, entitled "METHOD FOR SWITCHING BETWEEN PRODUCT TYPES ON A SORTING SYSTEM FOR SORTING PRODUCTS SUCH AS VEGETABLES AND FRUIT, AND SORTING SYSTEM THEREFOR," which claims priority to Netherlands App. No. 2016149 filed on Jan. 25, 2016, the entirety of the aforementioned applications are incorporated by reference herein.

The present invention relates to a method for switching from a first product type to a second product type on a sorting system for sorting products such as vegetables and fruit, and more particularly fresh fruit such as apples and pears. A product type relates here to another variety, such as an apple variety, or another product such as a switch from apples to pears.

Sorting systems are known in practice for sorting vulnerable products, in particular vegetables and fruit such as apples and pears. Such a conventional sorting system is for instance described in NL 2003166. Particularly described herein is a holder for sorting and/or transporting such products. In sorting systems known in practice a quantity of product of a specific product type is supplied and subsequently singulated, after which one or more measurements are performed on the product. On the basis of the performed measurements the product is assigned to a sorting class of the respective product and transported to a sorting outlet of the sorting device corresponding to this sorting class, usually in the form of a sorting channel. The sorting outlets of the sorting device are adjusted to a classification associated with the respective product, wherein each sorting class is linked to one or more outlets of the sorting device.

In the case of a switch from a first product type to a second product type on such a sorting system as known in practice the sorting system is first emptied, i.e. the sorting system remains in operation until all products of the first product type have been removed. Emptying of the sorting system takes some time, and is further prolonged in practice since discharge equipment for the further processing of products from the sorting system usually has a limited capacity and is shared by multiple sorting outlets. In a sorting system with for instance 60 outlets and 50 sorting groups or sorting classes allowance must be made for a switch-over time of 25-30 minutes.

In order to limit switch-over times the most intelligent possible planning is done in respect of batches to be sorted. Switch-over times do after all limit the realized capacity of the sorting system.

The present invention has for its object to provide a method with which it is possible to switch in more effective manner from a first product type to a second product type on a sorting system.

The present invention provides for this purpose a method for switching from a first product type to a second product type on a sorting system for sorting products such as vegetables and fruit, wherein the sorting system is provided with a sorting device comprising a number of sorting channels, wherein the method according to the invention comprises the steps of:

- a switch-over module receiving from a controller of the sorting system during sorting of products of the first product type a switching signal indicating that products of the second product type have to be sorted;
- the controller selecting some of the sorting channels of the sorting system which are free of products of the first product type, wherein the selected part of the number of sorting channels is smaller than the total number of sorting channels;
- assigning at least some of the selected part of the sorting channels to the second product type;
- assigning sorting classes of the second product type to one or more of the sorting channels of the selected part of the sorting channels assigned to the second product type; and
- during the emptying of the non-selected part of the number of sorting channels of the sorting device in respect of the first product type, sorting products of the second product type in the sorting channels assigned to the second product type in the selected part of the number of sorting channels to which a sorting class of the second product type has been assigned.

The sorting system is used to sort or pre-sort products. In the context of the description of the present invention 'sorting' is also understood to mean 'pre-sorting'. The sorting system according to the invention is related particularly to the sorting of preferably fresh products such as potato, vegetable and fruit products, and in particular apples and pears. A product type relates to a specific product, for instance apples or pears, and can also relate to a specific product variety, for instance different varieties of apple.

Products are supplied via a feed system to the sorting system via a feed belt or other feed conveyor. Supplied products are singulated using a singulating means, particularly such that they are preferably suitable for being measured with a measuring and classification system which preferably forms part of the sorting system. Following measurement products are classified on the basis of determined measured product characteristics. These are preferably one or more of the following characteristics: product dimensions, colour of the product, external quality, weight, internal quality and the shape of the product and/or further alternative and/or additional product characteristics. Products are assigned to a sorting class of the respective product on the basis of the characteristics. It is for instance determined for a supplied product that, with a size of 70-75 mm, the colour green and quality I, it falls in sorting class 5 and goes to outlet 17 of the sorting device.

The product is then delivered to the desired sorting outlet, for instance in the form of a sorting channel. Such a sorting channel is for instance a water channel and/or accumulative buffer lane. The sorting outlets then deliver the sorted products to the outlet of the sorting system where the classified products are made ready for further transport, storage and/or processing. A crate filler is for instance placed for this purpose at the outlet of a sorting channel.

The method according to the invention begins after a switching signal has been received with the first switching actions. The switching signal can be entered manually or be generated in automatic manner upstream in the product chain, for instance through detection of the type of product, information available about the number of crates/products for processing, information about the production planning compared to production progress etc. The receiving of the switching signal defines the beginning of the switch-over, wherein the sorting system according to the invention is switched in gradual manner from a first product type to a second product type.

For this purpose sorting channels which are clear of products of the first product type are selected following the start of the switch-over procedure. Since products of the first product type are still present in the sorting system, the selected part of the number of sorting channels is smaller than the total number of sorting channels. At least a part, and preferably all, of the selected sorting channels which are clear of products of the first product type are then assigned to the second product type. This means that products of the second product type can be introduced into the respective sorting channels assigned to the second product type. Sorting classes, or sorting groups, of the second product type are for this purpose assigned to these sorting channels. Use can be made here of a standard classification for this product type or of a specific classification for this product type.

The most common sorting classes are preferably first assigned to the available sorting channels so as to enable processing of as many products as possible of the second product type in effective manner in the sorting system. After assigning of the sorting class of the second product type products of the second product type are sorted in the sorting system simultaneously with emptying of sorting channels still provided with products of the first product type, wherein use is made of sorting channels which have been assigned to this second product type and to which a sorting class of the second product type has been assigned.

By utilizing sorting channels which are already clear, i.e. sorting channels in which products of the first product type are no longer present, for the purpose of sorting products of the second product type it is possible to start with feeding of products of the second product type relatively quickly after ending the feed of products of the first product type. This significantly reduces the switch-over time. This results in a greater effective sorting capacity of the sorting system realizable in practice by making use of the method according to the invention for switching between product types. A sorting channel can be used here for a residual category of the second product type, thereby generating a collection of products which cannot yet be sorted into the correct category because sufficient sorting channels are not yet available. This residual category can for instance be sorted again at a later stage. The assigning of sorting channels is preferably repeated over time, among other ways in that sorting channels become available for the second product type.

A greater flexibility of the sorting system is also obtained since a product switch has less of an effect on the sorting capacity achieved. Utilizing the switch-over system according to the invention enables a greater number of products to be sorted with the same sorting system and/or product switches to be dealt with in more flexible manner.

In an advantageous preferred embodiment according to the present invention the steps of the method of the controller selecting sorting channels which are free of products of the first product type and the switch-over module assigning selected sorting channels to the second product type are performed repetitively.

By performing the steps of selecting sorting channels and assigning the selected sorting channels to the second product type repetitively, i.e. repeating them over time, vacated sorting channels of the sorting system are utilized as well as possible. By emptying the sorting channels still filled with products of the first product type while sorting with products of the second product type is already taking place in other sorting channels, more and more sorting channels are vacated over time which can be utilized for products of the second product type. Repetitively comprises here of performing the respective steps additionally or again over time. This can be performed periodically at fixed intervals on continuous or semi-continuous basis or be performed on the basis of an event. Such an event can be a manual instruction, or also an automatic notification that the respective sorting channel is empty. Such an empty notification is preferably generated automatically using a detector.

Through repetitive performing of the different steps vacated channels are utilized as quickly as possible after being cleared of products of the first product type. The effective capacity of the sorting system for products of the second product type can hereby be increased more quickly. The step of assigning a sorting class of the second product type to such a sorting channel is preferably also performed repetitively here. In this way a further sorting class can be activated quickly so that a large group of sorting classes can be sorted as quickly as possible in effective manner for products of the second product type. This further increases the capacity of the sorting system for sorting products of the second product type. This further shortens the effective switch-over time.

In an advantageous preferred embodiment according to the present invention the assigning by the switch module of sorting classes of the second product type to one or more of the sorting channels assigned to the second product type in the selected part of the sorting channels is performed on the basis of a prioritization of sorting classes.

Assigning sorting classes to a sorting channel on the basis of a prioritization achieves that the available sorting channels are utilized as effectively as possible for products of the second product type while the sorting system is still engaged in processing products of the first product type in a number of the other sorting channels. It is hereby possible to employ the available sorting channels as effectively as possible for products of the second product type such that the largest possible group of products can be sorted in correct manner. Account is preferably taken here of the quantity of (anticipated) product per unit time in a class of the supplied batch of products of the second product type. By assigning product classes on this basis the effectiveness of the sorting system can be further increased during the switch-over period. This further reduces the effective switch-over time.

The prioritization is preferably carried out on the basis of information obtained by a measuring and classification system about the second product type which is gathered by measuring a first group of products of the second product type. Information about the distribution of product characteristics is obtained by measuring the first group of supplied products of the second product type, preferably using the measuring and classification system of the sorting system. It is possible on the basis hereof to look at how this batch of products of the second product type is distributed over the sorting classes associated with this product type. This information can then be taken into account when assigning sorting classes to available sorting outlets. This achieves that as many products as possible of the respective batch of the second product type are sorted as quickly as possible in correct manner. By making use of measurements actually performed on products supplied to the sorting system a prioritization can hereby be applied with reliable information for the purpose of assigning sorting classes to a sorting channel. The prioritization can hereby be adapted even better to the specific batch when compared to an alternative application with a general/average distribution of the products.

By advantageously making a choice as to which sorting classes are assigned to the available sorting outlet as available outlets become free the proportion of products which are immediately sorted properly is considerably higher than the percentage of available outlets. Products of the second product type which fall within a product class which has not yet been assigned to a sorting outlet preferably fall into a residual category and are processed separately.

In a further advantageous preferred embodiment according to the present invention a residual category for the second product type is assigned to one of the sorting classes assigned to the selected part of the sorting channels.

By preferably assigning a residual category as sorting class to at least one sorting channel all products which have been assigned to a sorting class to which a sorting channel has not yet been assigned can nevertheless hereby be processed. The products placed in this residual category have to be sorted again at a later stage. These products are collected from the respective sorting channel and later fed into the sorting system again. Products from the residual category are preferably fed back via a return channel of the sorting system. The sorting system is preferably provided for this purpose with such a return channel. Products can hereby be fed back to the inlet of the sorting system for a fresh sorting.

In a further advantageous preferred embodiment according to the present invention the method also comprises the step of preparatory emptying of some of the sorting channels in respect of the first product type prior to the switch from the first product type to the second product type.

Already starting with preparatory emptying of some of the sorting channels in which the products of the first product type are present before products of the second product type arrive at the sorting system achieves that some of the sorting channels are already clear of products of the first product type before these products are actually received. This achieves that it is immediately possible to proceed with feed of products, since a number of sorting channels are already available to be assigned to the second product type, and to subsequently assign relevant sorting classes thereto. One of the sorting channels is preferably used here as residual category for products of sorting classes which have not yet been assigned to a sorting channel. It has been found that the switch-over time can hereby be significantly reduced by this proactive action in accordance with an advantageous method according to the invention.

The preparatory emptying of a sorting channel is for instance carried out for a sorting channel which it is estimated on the basis of production data will no longer become sufficiently full and/or a sorting class which makes use of this sorting channel makes a very small contribution to the overall production. The sorting channels to be combined are preferably determined on the basis of a prioritizing of the sorting classes, for instance the sorting classes are combined which have the lowest quantity of product per unit time and/or sorting classes which are not sufficiently filled with the products still to be sorted. Such sorting classes can for instance be combined at one or several sorting channels and if desired be sorted again later. A free sorting channel can be used for this purpose, or a sorting channel which was in use as one of the sorting classes to be combined. A number of sorting channels can hereby be cleared in effective manner in a proactive way. This results in a significant time-saving. It is also additionally or alternatively possible to clear sorting channels of the first product type which would each not individually result in a full crate and to place these for instance in one crate. Use can advantageously be made here of information obtained by a measuring and classification system about products of the first product type during the sorting process, in particular about the distribution of these products over the different classes. Multiple sorting channels hereby become available simultaneously and can be utilized for the second product type.

Advantageously taken into consideration here is the quantity of product per sorting class still anticipated from the moment that the sorting class of the respective sorting channel must switch when it becomes full at the end of sorting of products of the first product type. If for instance the anticipated future number of products of the first product type is less than 30% of the volume of a crate, this sorting class can then for instance be linked to the residual category. The respective channel can in this way be proactively cleared as soon as a product switch is signalled. The switch-over time can hereby be further reduced.

By proactively defining a residual category of the first product type products of the first product type which are not in plentiful supply and/or products from a sorting class which for instance no longer has sufficient volume to completely fill a crate are combined in a residual category and sorted again later.

It is noted that an effective product switch can be performed by taking proactive action for a planned product switch. Such proactive action can also be carried out as independent action irrespective of the number of product types present in the sorting channels during emptying. It is thus possible for instance to carry out the product switch in conventional manner such that substantially only products of one product type are present simultaneously in the sorting device, wherein the above discussed proactive action is taken prior to the product switch. This can already significantly improve the effectiveness of the product switch.

By way of elucidating the foregoing, a determination of the residual category is given as example which is defined by sorting classes which are linked to a sorting channel in which it is apparent that too few products will be placed in the remaining time, for instance on the basis of: the production per hour× estimated remaining sorting time+ present content of the sorting channel <e.g 0.3× desired content of sorting channel.

As soon as a sorting class complies with this, it can go to the residual category. This is also possible for instance when the sorting channel linked to the sorting class becomes full and a new empty channel has to be selected. Despite the fact that the sorting class is for instance in plentiful supply, on the basis of the anticipated quantity of product it can be assigned to the residual category.

Another additional or alternative criterion can be that sorting classes have such a low production per hour that they fall in the lowest 30% for instance of the sorting classes.

In an embodiment in which a number of crate fillers are used, the processing per crate filler could for instance be to first determine which sorting channels are most suitable for advance emptying, to link the associated sorting groups to the residual category and to assign the residual category to an outlet. It is also possible to determine which of these sorting channels can be combined in one crate and to subsequently empty them.

When determining products to be combined, account is preferably taken of fruit characteristics which may or may not go together in one crate. Prevented here for instance is that rotting fruit is combined with quality I fruit.

Various of the above described steps are preferably combined in order to perform the switch from a first product type to a second product type on a sorting system as efficiently as possible. After a switching signal has been received, preferably in automatic manner using a sensor upstream in the supply of the products or in other automatic and/or manual manner, a start is therefore preferably made with proactive emptying of a number of sorting channels. Sorting channels which are for instance suitable here are the sorting channels to which a sorting class has been assigned into which only few products of the first product type fall, i.e. a sorting class at the tail end of the distribution. Alternatively or additionally suitable sorting classes are also those classes of which it is already known on the basis of available information that they no longer receive a sufficiently large number of products from the products of the first product type still to be expected, with which for instance a crate can be filled. The products which would otherwise fall into these sorting channels are then preferably grouped in a residual category which will eventually still be selected at a later stage. A first group of products of the second product type arriving at the sorting system is then preferably measured, on the basis which an expected distribution of this batch of products can be determined. On the basis of this distribution it is possible to determine which sorting classes will occur most frequently in this batch, so that these sorting classes will be the first to be assigned to the sorting channels which have become available. Products from other sorting classes are then preferably collected in a residual category which is assigned to a separate sorting channel. These products in the residual category collected with a sorting channel are eventually sorted at a later stage and/or preferably fed back via an optional return channel if the sorting system is provided therewith. These separate steps of clearing sorting channels of products of the first product type, assigning cleared sorting channels to the second product type and determining as well as possible the most suitable sorting class for this sorting channel are preferably performed repetitively in order to utilize sorting channels which have become newly available as quickly as possible for products of the second product type so as to further increase the effectiveness of the switch-over process.

The present invention also relates to a computer-readable medium comprising a computer program configured, when executed on a computer, to perform the steps of the method as described above.

The computer-readable medium provides the same advantages and effects as described for the method.

The present invention further relates to a sorting system for sorting products, in particular vegetables and fruit, comprising:

- a feed system;
- a sorting device connected operatively to the feed system and provided with sorting channels;
- a measuring and classification system connected operatively to the sorting device and provided with a sorting mechanism for sorting products over the sorting channels on the basis of the product classification obtained with the measuring and classification system;
- a controller configured to control at least the measuring and classification system and the sorting device,
- wherein the controller is provided with a switch-over module configured to perform a switch from a first product type to a second product type on the sorting system making use of a method as described above.

The sorting system provides the same advantages and effects as already described above for the method and/or the computer-readable medium. In an advantageous embodiment the sorting channels comprise water channels and/or accumulating buffer lanes, whereby the sorting system is exceptionally suitable for vulnerable products, in particular apples and pears. The sorting system is preferably also provided with a return channel for re-sorting of products, particularly configured to feed back products of the residual category. Products of a residual category collected with an assigned sorting channel are alternatively re-sorted at a later stage. Such a residual category relates particularly to products of the second product type which have been sorted and for which at that moment a sorting channel was not yet available and/or a first group of products of the second product type which have been used to determine the expected distribution of the respective batch over sorting classes.

Further advantages, features and details of the invention are further elucidated hereinbelow on the basis of preferred embodiments thereof, wherein reference is made to the accompanying drawings, in which.

Figure 1:
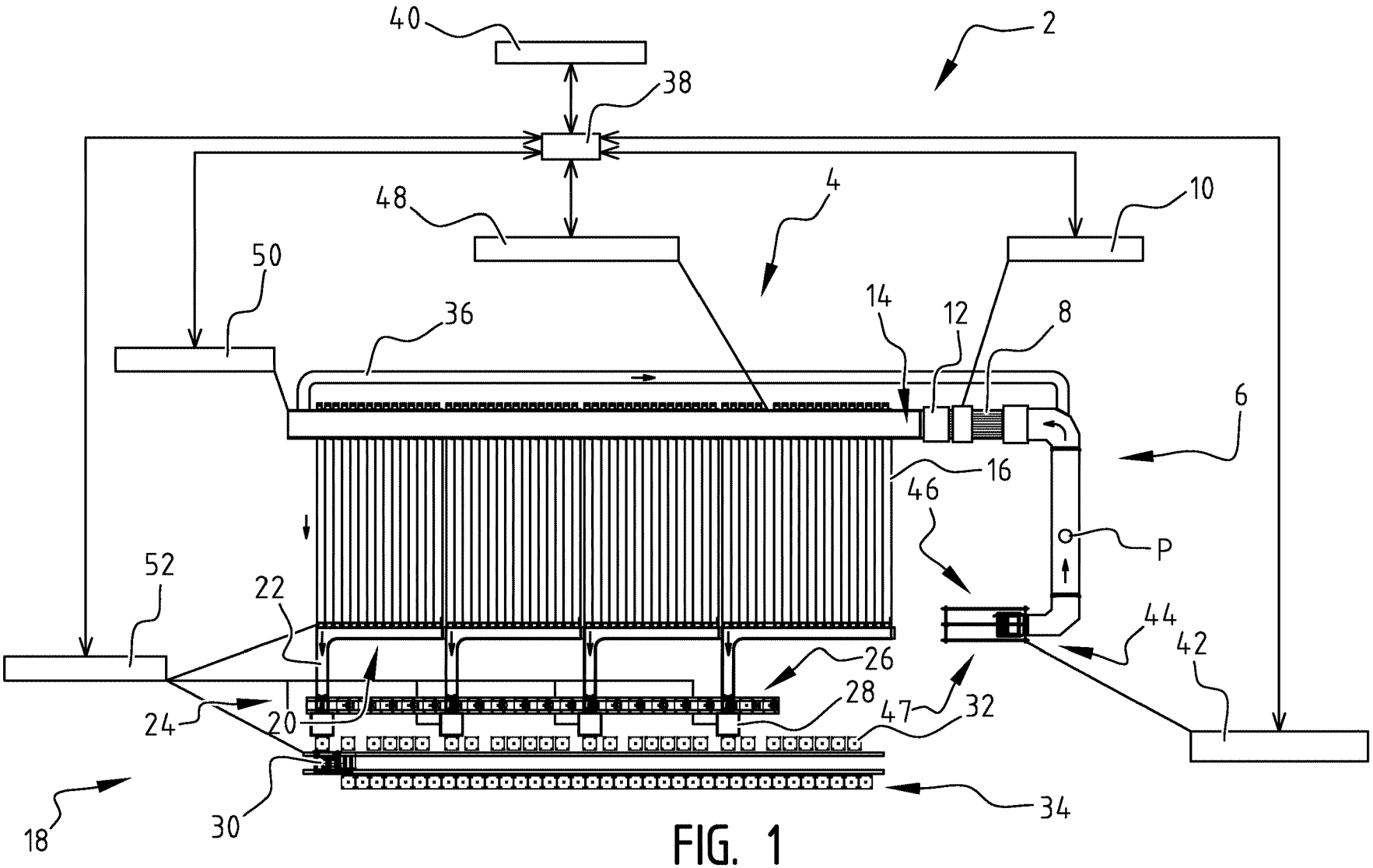
FIG. 1 is a top view of a (pre-)sorting system on which the method according to the invention can be applied.

Sorting system 2 (FIG. 1) comprises sorting device 4 and feed system 6 provided with singulating means 8. Sorting system 2 is further provided in the shown embodiment with measuring system or measuring or classification system 10, a transfer device 12 with which products P are laid in a bed of transport holders 14. Sorting device 4 also comprises a large number of sorting channels 16. The outlet of sorting channels 16 is operatively connected to discharge system 18. In the shown embodiment of discharge system 18 a group of sorting channels 20 is guided to a transverse channel 22 of sub-discharge system 24 which is provided with empty crate feed 26 and crate filler 28, for instance of the underwater filler type. In the shown embodiment there are four crate fillers 28 which are each connected using transverse channel 22 to about 15-20 sorting channels 20. It will be apparent that other configurations are likewise possible according to the invention. Filled crates 52 are placed on stacks 34 for discharge, preferably using automated system 30. These stacks 34 are then transported further for further treatment or storage.

In the shown embodiment sorting system 2 is also provided with return channel 36. In the shown embodiment return channel 36 is embodied, just as sorting channels 16, as water channel.

Sorting system 2 is provided in the shown embodiment with controller 38 with switch-over module and comprising a user interface 40. Controller 38 is preferably connected to control system 42 with which information is obtained using detector 44 in upstream feed part 46 with dumper 47. This is for instance information about the products of the first product type which are yet to be sorted and/or a notification of a product switch to the second product type. It will be apparent that this information can also be obtained in other automatic and/or manual manner Controller 38 makes use of sorting channel control 48. It will be apparent that such a module, as well as other modules, can be integrated into controller 38 and/or can be arranged as separate controllers. Measuring system 10 is likewise connected operatively to controller 38. In the shown embodiment controller 38 is also connected operatively to position controller 50 and flow controller 52. It will be apparent that diverse variants of sorting system 2 are possible. It is thus possible for instance to dispense with return channel 36, to vary the number of sorting channels 16, configure discharge system 18 differently and configure feed system 6 differently, to give controller 38 a central and/or local form, and the like.

Natural products in particular, such as vegetables and fruit, display a natural variation in product characteristics. The probability density function of for instance product diameter or product weight of unsorted products usually has a normal distribution in practice. More products will hereby fall into the one sorting class than into another sorting class. By combining these product characteristics with additional product characteristics such as colour, bloom, external quality and so on, the distribution of products over sorting classes usually becomes even more uneven. A typical ratio here is that 20% of the sorting classes comprises about 80% of the products. The distribution of products over the sorting classes and sorting channels is tracked in sorting system 2 so that the probability of a product falling into a specific channel and the probability of a product falling within a determined sorting class are known.

In the shown embodiment according to sorting system 2 unsorted product P is for instance dumped in water in feed system 46 with dumper 47 in the feed part and subsequently carried by feed system 6 to singulating means 8. Here product P leaves the feed bath, subsequently comes to lie behind other products P and is preferably transported further while being rotated. Measuring system or measuring and classification system 10 measures characteristics of product P, after which it is classified. Product P is then placed by transfer device 12 into a transport holder of bed 14, wherein product P is preferably also weighed. After product P has been assigned to a sorting class, and when the sorting class has been assigned to a specific sorting channel 16, product P is then transported on bed 14 to the respective sorting channel 16 and there released. Sorting channel 16, preferably a water channel and/or accumulating buffer lane, comprises a number of products P and thereby fulfils a buffer function. Controller 48 tracks how many products P lie in the channels and will if desired select another sorting channel for this sorting channel when sorting channel 16 is fully filled. When discharge system 18 is ready to fill sorting channel 16 and sorting channel 16 comprises enough products to fill for instance a crate, sorting channel 16 is emptied and the products are carried into crate 32, for instance using crate filler 28, which is subsequently placed on a stack 34 for discharge, for instance with a crate stacker 30.

Depending on the embodiment of sorting system 2, the embodiment of discharge system 18 is taken into account so that it is for instance possible to take into account during proactive emptying of sorting channels 16 that crate fillers 28 are utilized as effectively as possible. During the proactive emptying of a sorting channel 16 use is optionally made of an adjustable percentage of sorting channels which have to be empty prior to the product switch. The time to start proactive action can also be determined on the basis of the crates still to be sorted and the related sorting time. It is also possible to take into account the quantity of product to be expected per sorting class between the moment that the sorting class of a sorting channel must change because the channel is full and the end of the sorting of the products of the first product type. If this remaining quantity is for instance less than 30% of the crate volume, this sorting class can then be linked to the residual category so that products can be sorted again at a later stage.

Figure 2A:
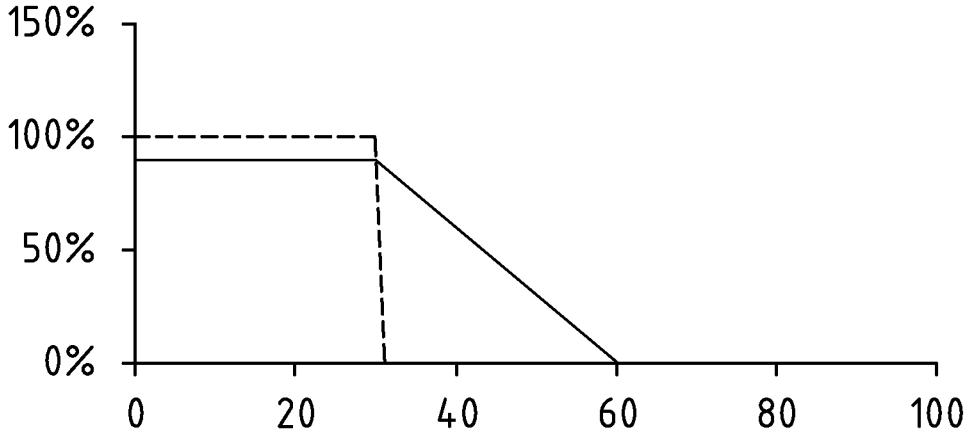
FIG. 2 shows a view of results with a conventional product switch.
Figure 2B:
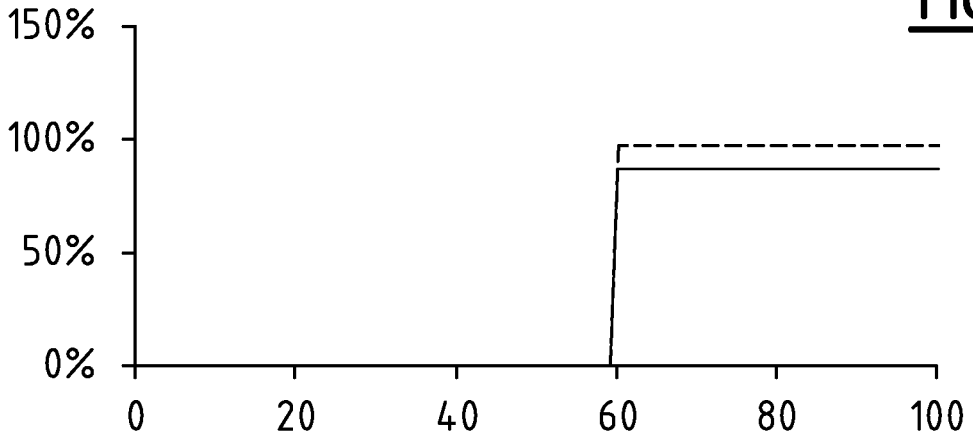
Figure 2C:
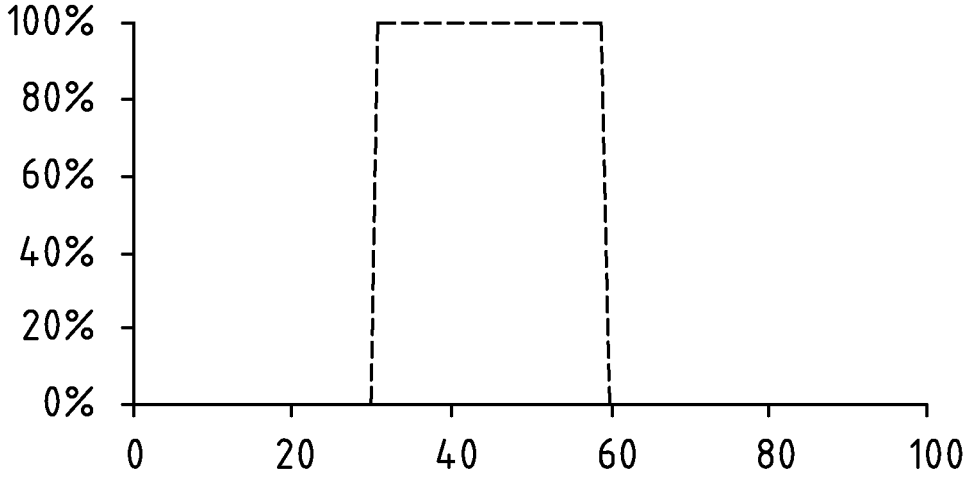

In a conventional application with a capacity of for instance 100 crates per hour for crate stacker 30 about thirty minutes is required to empty fifty channels 16. The results of such a conventional method for the purpose of a switch-over are shown in FIG. 2. At a time 30 minutes the processing of products of the first product type stops, after which outlets 16 are emptied in about 30 minutes. From a time 60 minutes the new product of product type 2 can be sorted. The total switch-over time in a conventional process therefore amounts to about 30 minutes.

FIGS. 2-7 show, A, scaling down of the sorting of the first product type, B, scaling up of the sorting of the second product type and, C, the production time loss represented by the area below the curve/line. The broken line in the figures relates to the production/sorting and the full line relates to the percentage of channels in use for the respective product type.

Several steps according to embodiments of the method according to the invention are then applied in the situation which is otherwise the same as above in the conventional process. For the sake of clarity in the graphs the maximum number of outputs is defined at 95%. This does not affect the comparison of a conventional process and embodiments according to the present invention. The productivity loss relates to the decrease in products processed by discharge system 18. The effective switch-over time can be determined by relating this productivity loss to the theoretically realizable capacity of sorting system 2.

Figure 3A:
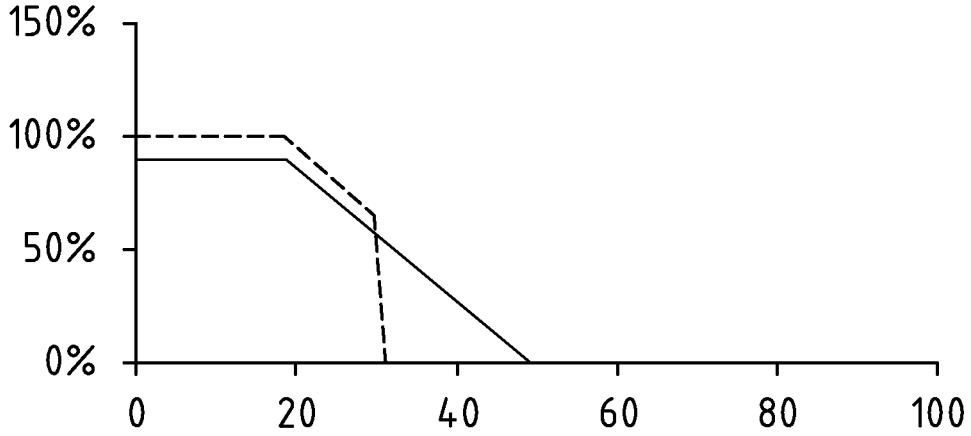
FIG. 3 shows results of the effect of proactive emptying of sorting channels.
Figure 3B:
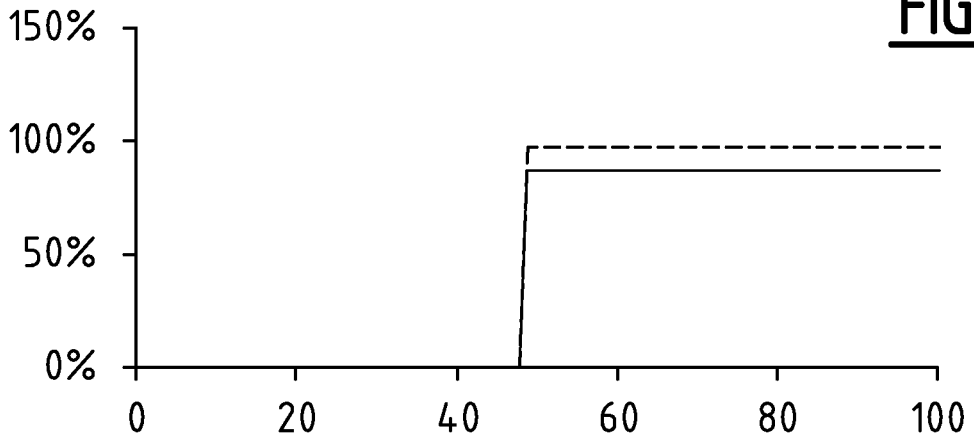
Figure 3C:
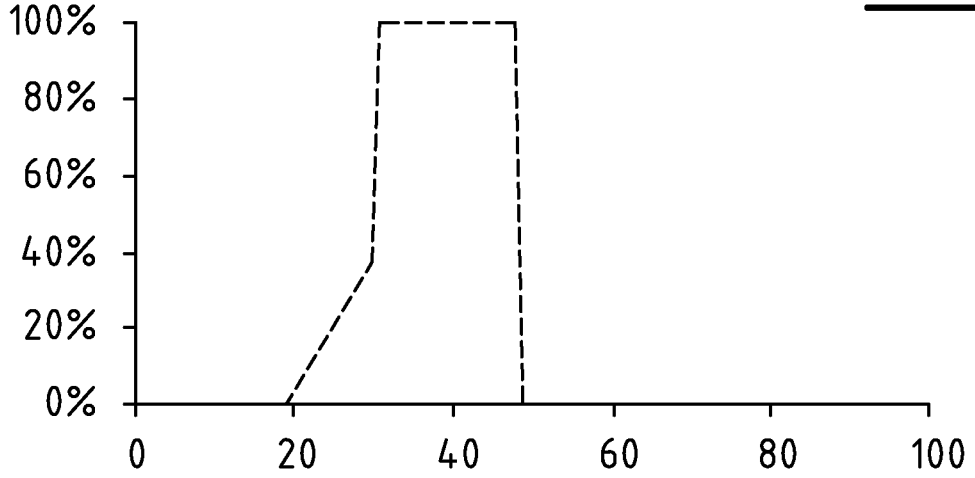
Figure 4A:
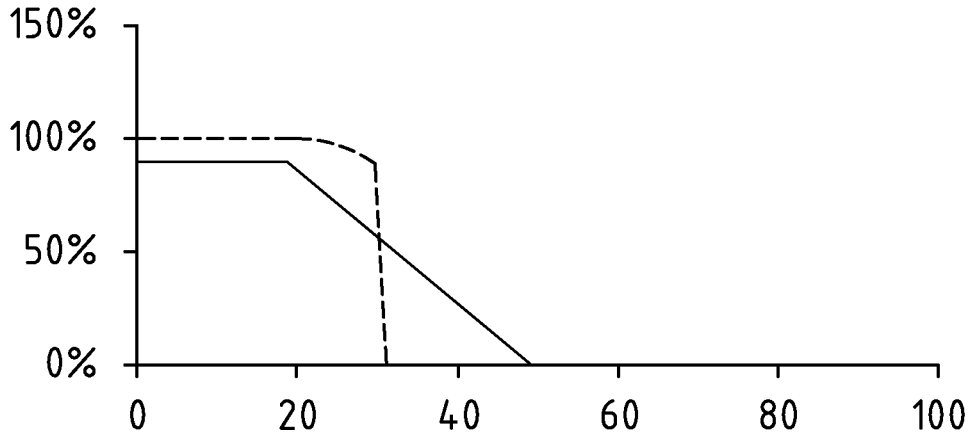
FIG. 4 shows results of the effect of optimized proactive emptying.
Figure 4B:
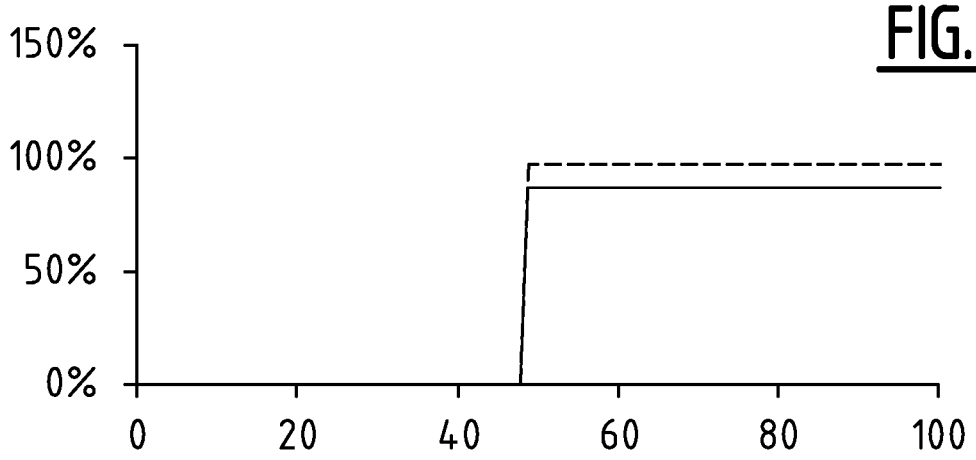
Figure 4C:
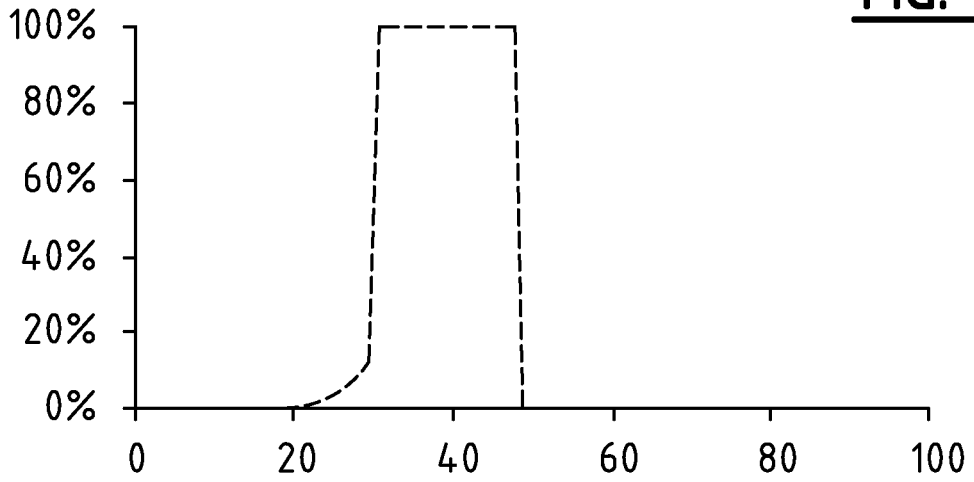

In the case a first proactive action is performed after a coming product switch has been signalled, a number of outlets are emptied at time twenty minutes. The results hereof are shown in FIG. 3. The emptied outlets are for instance outlets which it is estimated on the basis of production data will no longer become sufficiently full and/or of which the sorting classes assigned to the sorting channels will make only a limited contribution to the total production. The relevant sorting classes are combined on one or several sorting channels and usually sorted again later. This is visible as productivity loss with a gradual increase between the times twenty and thirty minutes. In the shown example 30% of the sorting outlets are emptied in this period of time and thereby made available to products of the second product type. By making use of prioritization on the basis of the above criteria the sorting channels for proactive emptying can be intelligently chosen, whereby the number of channels which are cleared increases more quickly than the decrease in the properly sorted product. This is shown in FIG. 4 wherein it can be seen that the productivity loss is smaller and the total switch-over time is further reduced from about twenty minutes to about eighteen and a half minutes. In both cases the sorting of products of the first product type is stopped at the time thirty minutes. In a non-optimized embodiment sorting of products of the second product type starts at the time fifty minutes, while in an optimized proactive step it is already possible after eighteen and a half minutes to start with sorting of products of the second product type.

Figure 5A:
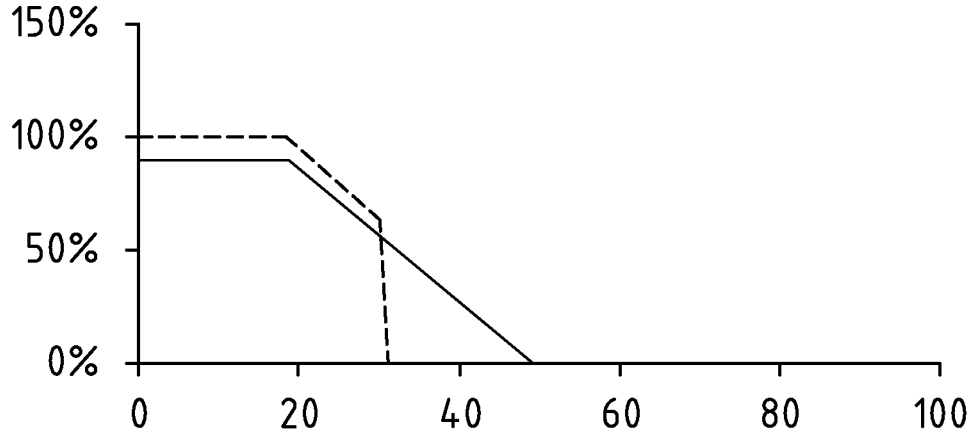
FIG. 5 shows results wherein products of the second type are sorted while products of the first type are being emptied.
Figure 5B:
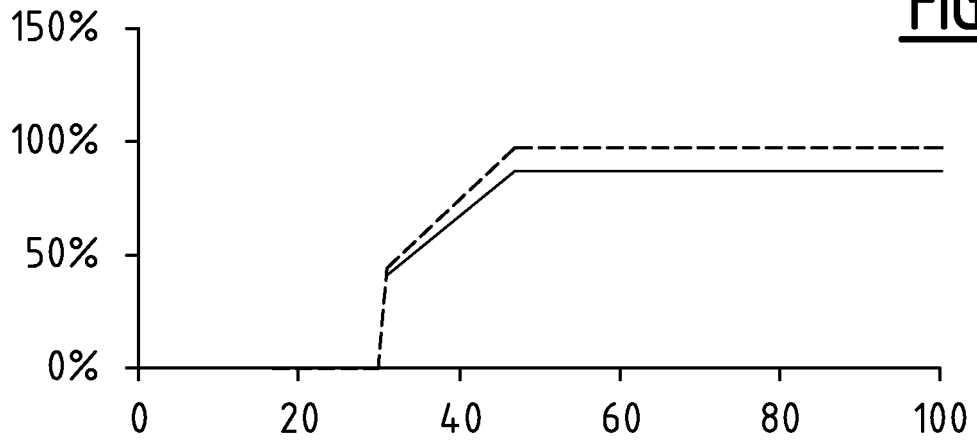
Figure 5C:
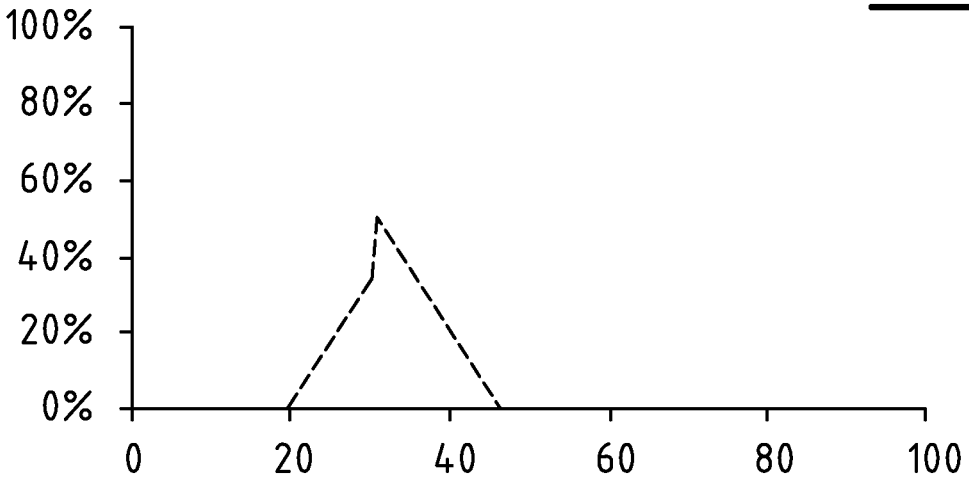

In a further example proactive use is made of clearing sorting channels without optimization, and sorting classes are assigned to sorting outlets without prioritization when starting the sorting of products of the second product type. This achieves a significant reduction in switch-over time from thirty minutes to about six and three-quarter minutes. This is shown in the results of FIG. 5, wherein a significant reduction in the productivity loss is realized.

Figure 6A:
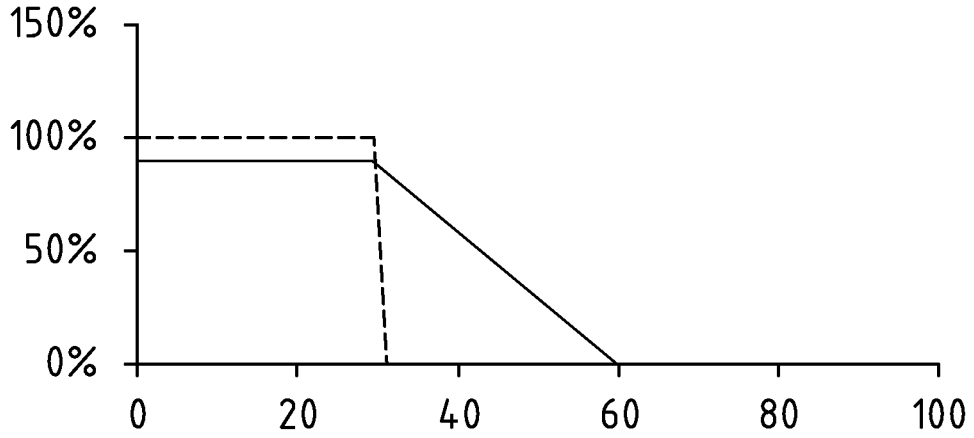
FIG. 6 shows results of the effect of optimized starting of the new sorting.
Figure 6B:
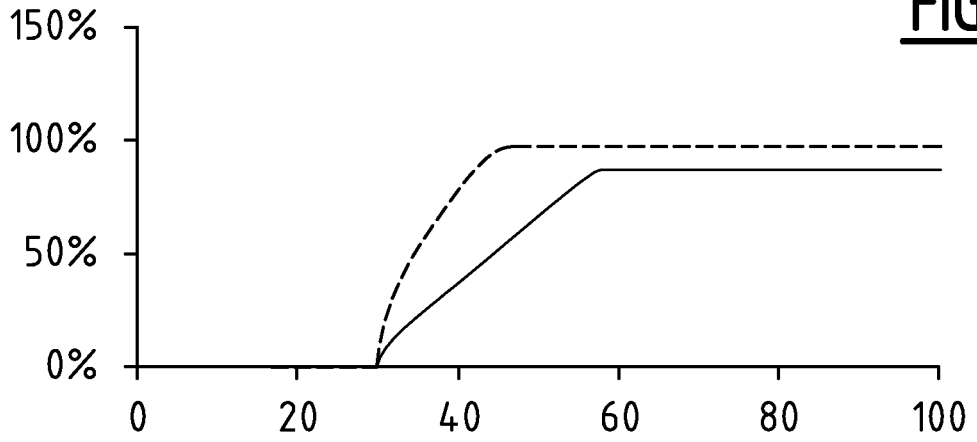
Figure 6C:
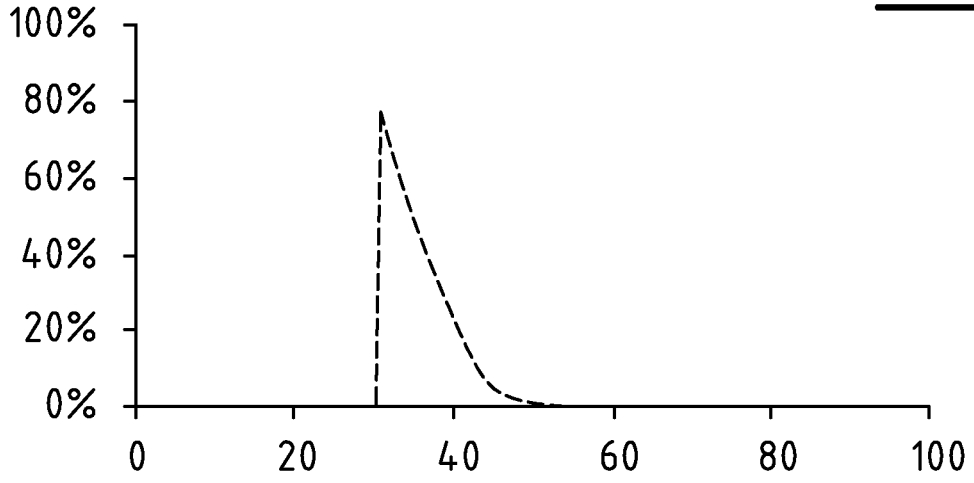

In the case of prioritization during assigning of sorting classes of the second product type to sorting channels 16 which have become available it is possible in the first instance to assign all sorting classes to one sorting channel which is defined as residual category. By measuring products for several seconds or a minute for instance, the expected distribution function of the products over the sorting classes can be determined. Use can additionally or alternatively be made here if desired of a distribution function on the basis of historical data which are retrievable from a database or which is already available in controller 38. By starting with sorting of products of the second product type from time thirty minutes and guiding products in the first instance to the residual outlet until a reliable estimate of the distribution of the products over the sorting classes is available, and subsequently assigning sorting classes to sorting channels with prioritization on the basis of the expected specific distribution determined for the relevant batch, a sorting class in which many products are expected can be assigned first to the sorting channel which has become available. The percentage of properly sorted product of the second product type can hereby be much higher from the start than the percentage of available sorting channels (FIG. 6). Only the products which come together in the residual category contribute toward the undesirable productivity loss of the lower graph and have to be sorted again. The switch-over time amounts in this example to about six minutes. It is possible according to the invention if desired to limit the number of products to be re-sorted, and thereby further reduce the risk of damage to products, by only beginning with sorting of the product of the second product type when a determined percentage of sorting outlets is available, for instance 20%.

Figure 7A:
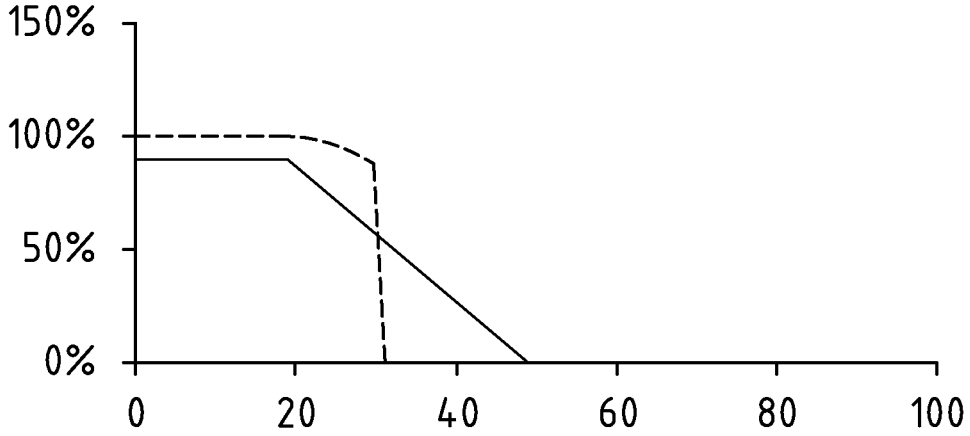
FIG. 7 shows results of the effect of both optimal proactive emptying and optimal starting.
Figure 7B:
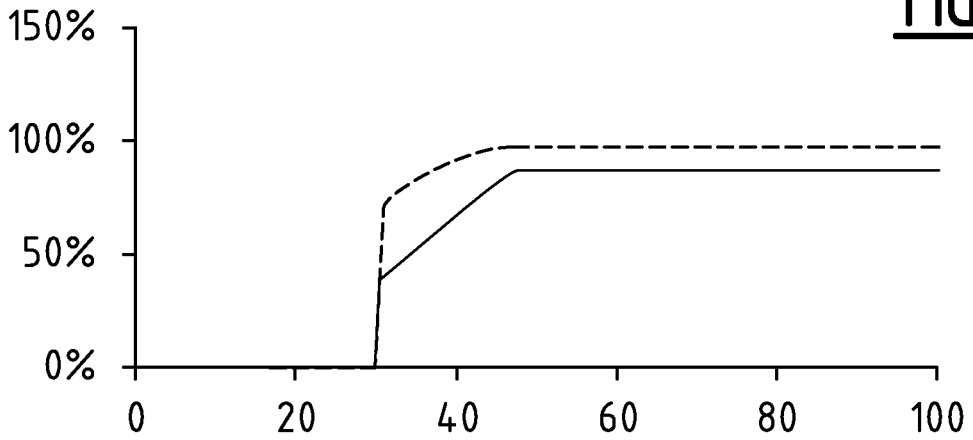
Figure 7C:
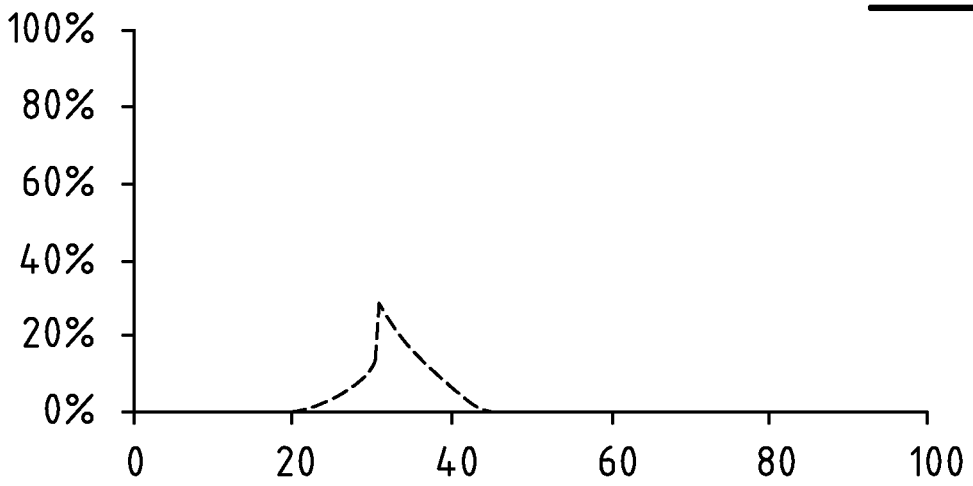

An optimal effect and maximum reduction in the switch-over time for sorting products of the first product type to products of the second product type is realized by applying a combination of the above effects. By carrying out repetitively and on the basis of quality the emptying of sorting channels and the assigning of sorting classes of the second product type over sorting channels which have become available, a further reduction in the switch-over time is obtained to about two minutes (FIG. 7). Between times twenty and thirty minutes the sorting of products of the first product type is scaled down. At time thirty minutes a start is made with sorting of products of the second product type. All sorting channels with the old product are empty at time fifty minutes and at that moment all sorting classes of the product of the second product type also have their own sorting channel. Productivity loss and the effective switch-over time hereby remain limited.

The above examples have been obtained with sorting system 2 on which the different effects are applied individually as far as possible. The results in FIG. 7 relate to a combination of the individual steps which results in the greatest reduction in effective switch-over time and productivity loss.

A further example is described below on the basis of a practical simulation wherein a product switch is carried out from apples of the Golden Delicious variety as first product type to apples of the Elstar variety as second product type. Both varieties have 50 sorting groups. The sorting system used has 60 sorting channels and a capacity of about 30 ton/hour. The total feed capacity is hereby about 100 crates/hour. The discharge for sorted products is formed by the sorting channels (16), four underwater fillers (28) and a so-called binmatic (30) which stacks the crates filled by underwater filler (28). These underwater fillers and binmatic can process about 140 crates/hour.

Figure 8A:
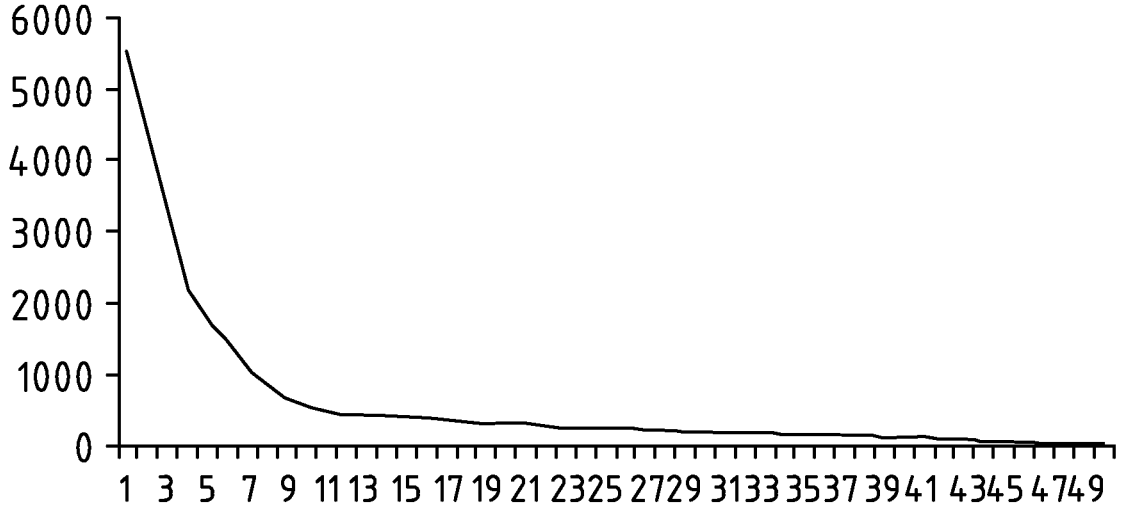
FIGS. 8-11 show results of an example of a product switch according to the invention.
Figure 8B:
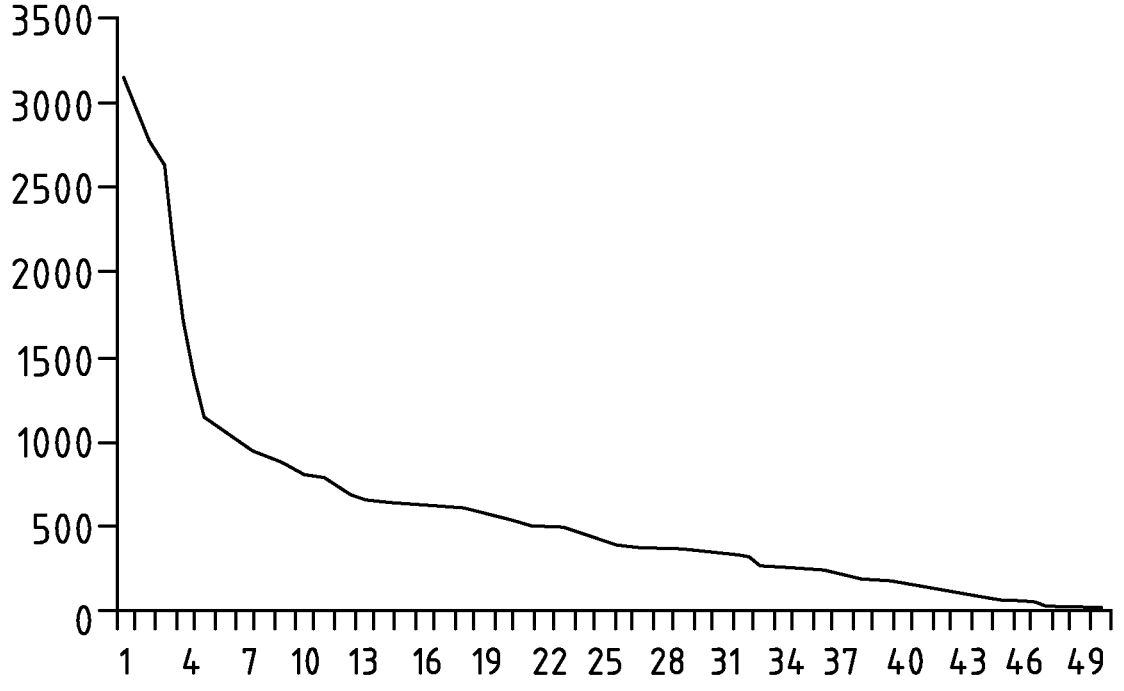

A typical distribution of the production per sorting group for Golden Delicious is shown in FIG. 8A. Several sorting groups deliver 5-6 tons per hour, a large part is well below this and several sorting groups deliver very little fruit, for instance only 300 kg per eight hours. The distribution for Elstar as shown in FIG. 8B is roughly the same.

In a conventional product switch all sorting channels (16) are emptied. A minimum of 21 minutes is necessary for this purpose. Of the 50 sorting channels used, about 30% will usually be filled for less than 30% with products. In order to limit storage space these products are usually placed in a crate combined with residual product. At a typical channel content of about 300 kg this results in about 675 kg of residual product. This amount can of course vary. After emptying of the system a start is made with the second product, the Elstar, on the desired 50 sorting channels.

For an optimized product switch according to the invention a signal is given upstream in the process to initiate the switch about 30 minutes before the intended switch. At that moment 50 crates with a total of about 15,000 kg of apples of the first variety still have to be sorted. Two ways of making sorting channels available to the second variety are applied according to the invention.

The first way is to end the least productive sorting groups during the final phase of the sorting of the Golden Delicious variety and to empty the channels by making use of the overcapacity of the underwater fillers. In addition to the normal full notification for outlets because of the current sorting process for Golden Delicious, those outlets linked to the least productive sorting groups, for instance the 15 least productive sorting groups, are also notified as being full. These sorting groups are unlinked from the associated outlets and assigned to a residual outlet. The associated outlet is notified to the underwater filler for filling of a crate. This is possible for instance by unlinking all 15 least productive sorting groups at the same moment and notifying them to the underwater filler for the purpose of being emptied. The underwater fillers have overcapacity of a total of 40 crates per hour, so the 15 notified outlets will be empty again after about 23 minutes. Another way is to distribute the unlinking of these slow running sorting groups over the available time until the switch in variety. This is possible for instance by looking every two minutes at which remaining sorting group is the least productive and subsequently unlinking it and notifying the associated channel as being full, or, for instance as soon as an underwater filler no longer has any channels notified as full, unlinking the slowest running sorting group connected via a channel to this underwater filler. An additional advantage of the latter two variants of unlinking less productive sorting groups is that the quantity of product which is placed in the residual group is much less than in the first variant.

The second way is to check during the final phase of the sorting process of the Golden Delicious variety at each channel which becomes full whether sufficient fruits are still expected for the sorting group associated with this channel. If on the basis of the production statistics this is then less than for instance 30% crate filling, a new sorting channel is not selected for the respective sorting group, and it is added to the residual outlet. About 30% of the sorting groups are hereby eventually terminated and combined in the residual outlet.

Figure 9:
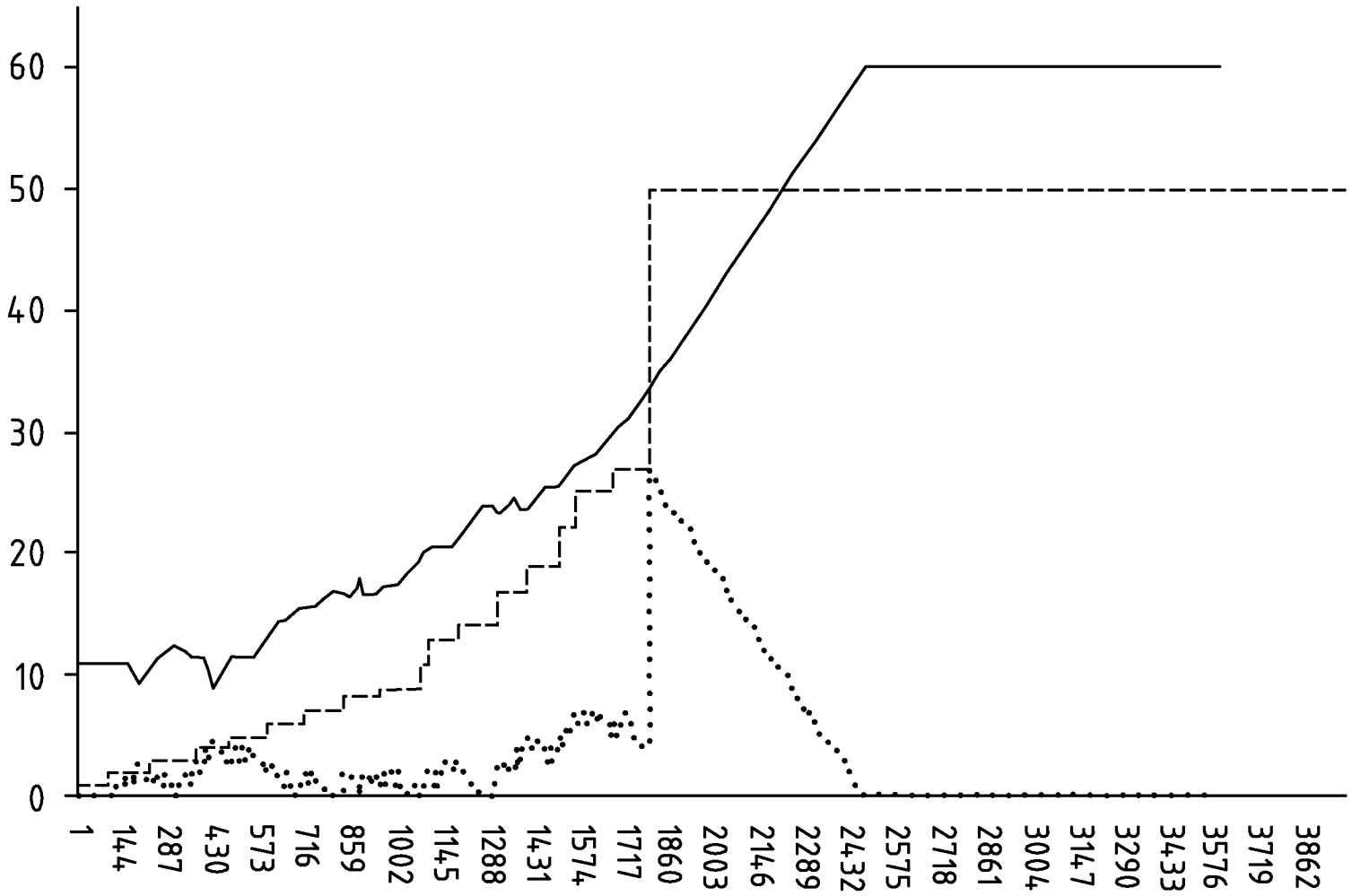

All outlets notified as being full at an underwater filler are processed individually. If multiple outlets are notified simultaneously as being full, it will then therefore take some time before they are all emptied. In FIG. 9 (full line represents the number of empty channels, broken line represents the number of terminated sortings and the dotted line the number of channels waiting) the relation is shown between the number of channels notified as full and the number of emptied channels. As shown in FIG. 9, there is a slight lag in empty channels becoming available when the sorting group is terminated. The momentary number of channels which have to be emptied by the underwater fillers is shown on the dotted line, this including the number of channels notified as full by the current sorting process. When a channel is notified as being full without the sorting group being terminated, an empty channel is again immediately selected for further sorting. This is the reason that the line for the empty channels has an irregular progression. At the moment of the switch in variety, at time t=1800 seconds, all other channels are notified as full and the number of waiting channels peaks at 25. The full line, which represents the number of empty channels, shows that this has risen from 10 free channels at t=0 to 32 free channels at t=1800 seconds.

Figure 10:
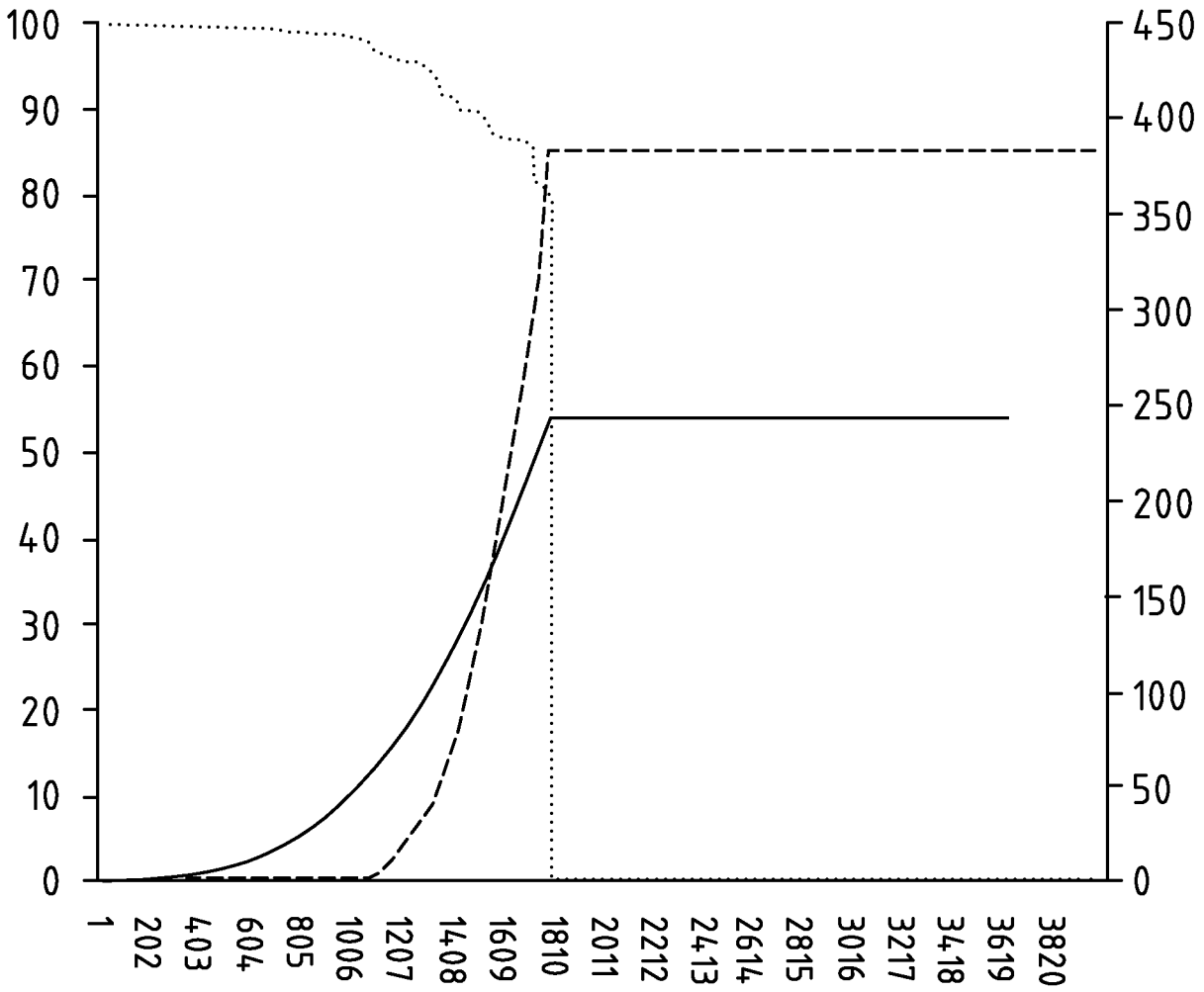

As described above, two ways of terminating sorting groups are applied. First of all the least productive groups are terminated one by one, distributed over the remaining time. Secondly, each time a channel is full a check is made as to whether the associated sorting group can be terminated because the anticipated quantity of residual product up to the switch in variety is less than 30% channel filling. The result is shown in FIG. 10 (full line represents the number of kilograms as a result of terminating less productive groups, broken line represents the number of kilograms residual product as a result of a small remainder following full notification and the dotted line the percentage of correctly sorted products over time). The quantity of residual product which occurs in the variety switch-over process is indicated separately for termination of less productive groups and for termination for the purpose of preventing a channel with a small residual quantity. In this example the total quantity of residual product resulting from premature ending of sorting groups amounts to 250+375=625 kg. It should be noted here that some of the 15 less productive sorting groups which are terminated also have a channel filling which is less than 30%. This results in an estimated additional quantity of residual product of ½*0.3*15*0.3*300=203 kg. In this specific simulation this is 88 kg. These channels can be efficiently cleared by for instance having them together fill one crate (to the extent they are connected to the same underwater filler) and/or by employing them as an outlet for the residual group. In this latter case the number of extra outlets and crates for filling necessary for the residual group is very limited.

Figure 11:
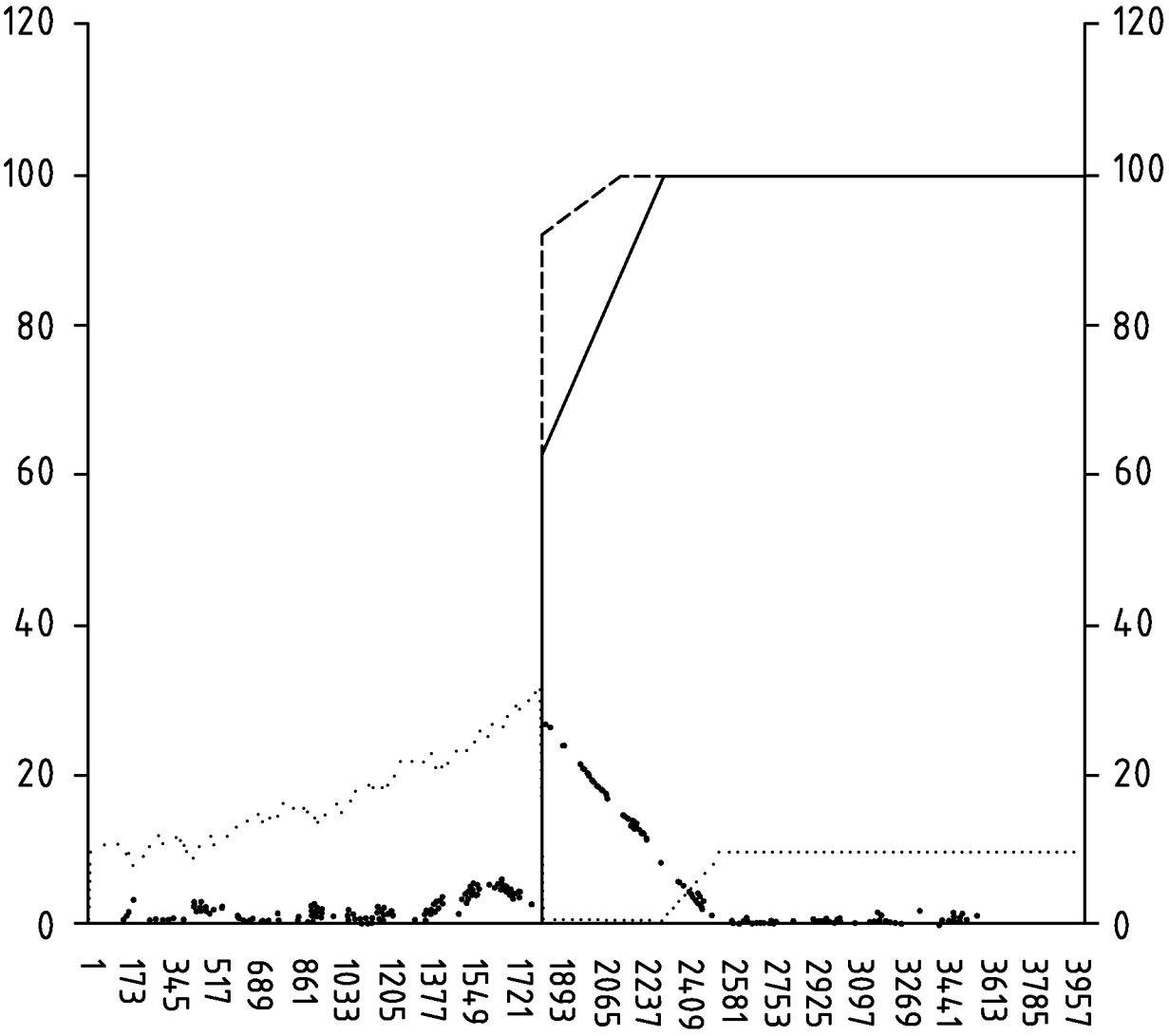

At time t=1800 s the sorting of the Golden Delicious variety is ended. Owing to the proactive emptying of channels, 32 outlets are at that moment available (see FIG. 9). The other 28 outlets still comprise fruits and still have to be emptied. As of t=1800 s fruits of the Elstar variety are guided over the machine. For the first 20-40 seconds the fruits are measured in order to make an assessment of the distribution of the fruits over the sorting groups. During this time the fruits are assigned to a residual outlet. The sorting groups are assigned their own sorting channel in order of productivity. Each time a sorting channel becomes available it is assigned to the sorting group with the highest priority which is then not yet linked. The effect on productivity of linking sorting groups to channels is shown in FIG. 11 (full line represents percentage of linked sorting groups, small dotted line the net number of free channels, large dotted line the number of channels waiting and the broken line the percentage of effective production). In the figure the number of channels waiting and the net free channels for 0<t<=1800 are equal to the corresponding numbers in FIG. 9. Further shown is that at the start more than 60% of the sorting groups are already linked to their own outlet. With the correct choice of these sorting groups more than 90% of the production will then already arrive at the correct outlet. The other sorting groups remain linked to a residual outlet until a sorting outlet becomes available.

At t=2294 the final sorting group is linked to its own sorting channel. In the simulation the quantity of residual product is 194 kg. An approximation of the quantity of residual product can be given on the basis of the graph by measuring the area between the 100% line and the effective production line between times t=1800 and t=2294. An estimate hereof amounts to 206 kg.

A further optimization can be realized when starting the new sorting by an optimal assignment. As stated, fruits of a sorting group are assigned to a residual outlet as long as an outlet of its own is not available for a sorting group. This residual outlet can in principle be any random outlet of the machine. The assignment of the fruits to outlets takes place as soon as the fruits come from the singulating means and have been weighed. In the case the residual outlet lies further toward the end of the machine, this means that a considerable quantity of fruit is in transit on the cup bed. As soon as a sorting group is linked to an outlet, fruits of the same sorting group are possibly still in transit to the residual outlet. It is in that case worthwhile, for all fruits of this sorting group which are still lying on the cup bed and which have not yet passed the outlet that has just been linked, to implement a mutation by nevertheless unlinking them from the residual outlet and linking them to the outlet of the sorting group which has just been assigned, to unload the fruit there, and to also update the registrations of the sorting group, the sorting outlet and the residual outlet on the basis of the implemented mutation. This will result, certainly at the beginning of sorting of the new product, in a saving on the quantity of residual product. Sorting of several hundred fruits, or for several tens of seconds, then takes place solely in order to determine the distribution of the sorting groups. Since the transit time over the cup bed to the final ($60^{th}$) outlet lasts for about 45 seconds, it is in this way possible at the beginning of the new sorting to ensure that many fruits used to determine the distribution of the sorting groups will nevertheless arrive at the outlet linked to the sorting group instead of at the residual outlet. This can be optimized still further by selecting the residual outlet at the end of the machine at the beginning of the new sorting, and by then allocating the sorting groups which are most represented to the free outlets likewise located at the end of the machine. The greatest possible part of the fruits will hereby still arrive directly at the correct outlet of the sorting group.

The present invention is by no means limited to the above described preferred embodiments thereof. The rights sought are defined by the following claims, within the scope of which many modifications can be envisaged.

The invention claimed is:

1. A method for switching from a first product type to a second product type on a sorting system for sorting products provided with a sorting device comprising a number of sorting channels, the method comprising:

supplying products via a feed system;

singulating the supplied products using a singulator;

measuring the products;

classifying each of the products into a sorting class based on measured product characteristics;

receiving by a switch-over module from a controller of the sorting system during sorting of singulated products of the first product type a switching signal indicating that singulated products of the second product type have to be sorted;

selecting by the controller part of the sorting channels of the sorting system which are free of products of the first product type, wherein the selected part of the number of sorting channels is smaller than a total number of the sorting channels;

assigning at least some of the selected part of the sorting channels to the second product type;

assigning sorting classes of the second product type to one or more of the sorting channels of the selected part of the sorting channels assigned to the second product type; and during emptying of a non-selected part of the number of sorting channels of the sorting device in respect of the first product type, sorting products of the second product type in the sorting channels assigned to the second product type in the selected part of the number of sorting channels to which a sorting class of the second product type has been assigned.

2. The method of claim 1, wherein selecting by the controller sorting channels which are free of products of the first product type and the switch-over module assigning selected sorting channels to the second product type are performed repetitively in respect of at least additional sorting channels of the sorting system which become available over time and which are clear of products of the first product type as a result of emptying sorting channels in respect of the first product type.

3. The method of claim 2, wherein assigning a sorting class of the second product type to sorting channels selected for the second product type in the selected part of the sorting channels is performed repetitively.

4. The method of claim 1, wherein the assigning by the switch-over module of sorting classes of the second product type to one or more of the sorting channels assigned to the second product type in the selected part of the sorting channels is performed on the basis of a prioritization of sorting classes.

5. The method of claim 4, wherein the prioritization comprises a quantity of product in a class per unit time.

6. The method of claim 4, wherein the prioritization is carried out based on information obtained by a measuring and classification system about the second product type which is gathered by measuring a first group of products of the second product type.

7. The method of claim 1, wherein one of the sorting classes assigned to the selected part of the sorting channels comprises a residual category of the second product type.

8. The method of claim 1, further comprising preparatory emptying of a part of the number of sorting channels in respect of the first product type prior to the switch from the first product type to the second product type.

9. The method of claim 8, wherein some product classes of the first product type are combined in a residual category of the first product type on the basis of a prioritization.

10. The method of claim 9, wherein the residual category of the first product type is assigned to one or more available sorting channels.

11. The method of claim 9, wherein the prioritization comprises a quantity of product of the first product type in a class per unit time.

12. The method of claim 9, wherein the prioritization is carried out based on information obtained by a measuring and classification system about the first product type which is gathered by measuring products of the first product type.

13. The method of claim 9, wherein the prioritization is carried out based on a quantity of the first product type still to be expected per class.

14. The method of claim 7, further comprising sorting the products from the respective residual category again at a later stage.

15. The method of claim 7, wherein the products from the respective residual category are fed back via a return channel.

16. The method of claim 1, wherein preparatory emptying of at least a part of the number of sorting channels takes place in respect of the first product type prior to the switch from the first product type to the second product type.

17. A non-transitory computer-readable medium comprising a computer program configured, when executed on a computer, to perform a method for switching from a first product type to a second product type on a sorting system for sorting products provided with a sorting device comprising a number of sorting channels, the method comprising:

supplying products via a feed system;

singulating the supplied products using a singulator;

measuring the products;

classifying each of the products into a sorting class based on measured product characteristics;

receiving by a switch-over module from a controller of the sorting system during sorting of products of the first product type a switching signal indicating that products of the second product type have to be sorted;

selecting by the controller part of the sorting channels of the sorting system which are free of products of the first product type, wherein the selected part of the number of sorting channels is smaller than a total number of sorting channels;

assigning at least some of the selected part of the sorting channels to the second product type;

assigning sorting classes of the second product type to one or more of the sorting channels of the selected part of the sorting channels assigned to the second product type; and during emptying of a non-selected part of the number of sorting channels of the sorting device in respect of the first product type, sorting products of the second product type in the sorting channels assigned to the second product type in the selected part of the number of sorting channels to which a sorting class of the second product type has been assigned.

18. A sorting system for sorting products, comprising:

a feed system;

a sorting device connected operatively to the feed system and provided with sorting channels;

a measuring and classification system connected operatively to the sorting device and provided with a sorting mechanism for sorting products over the sorting channels on the basis of product classification obtained with the measuring and classification system;

a controller configured to control at least the measuring and classification system and the sorting device; and a switch-over module configured to receive from the controller a switching signal indicating that products of a second product type have to be sorted, wherein the controller is configured to select part of the sorting channels of the sorting system which are free of products of a first product type, wherein the selected part of the number of sorting channels is smaller than a total number of the sorting channels, wherein the controller is configured to assign at least some of the selected part of the sorting channels to the second product type, wherein the controller is configured to assign sorting classes of the second product type to one or more of the sorting channels of the selected part of the sorting channels assigned to the second product type, and wherein the controller is configured to sort, during emptying of a non-selected part of the number of sorting channels of the sorting device in respect of the first product type, products of the second product type in the sorting channels assigned to the second product type in the selected part of the number of sorting channels to which a sorting class of the second product type has been assigned.

19. The sorting system of claim 18, wherein the sorting channels comprise water channels and/or accumulating buffer lanes.

20. The sorting system of claim 18, further comprising a return channel for re-sorting of products.

* * * * *